United States Patent [19]

Gregory

[11] 4,128,134

[45] Dec. 5, 1978

[54] METHOD AND APPARATUS FOR DETERMINING THE ORIENTATION OF A CORE CUT IN A BORE HOLE

[76] Inventor: Frank Gregory, 71 Summit Ave., Waldwick, N.J. 07463

[21] Appl. No.: 816,912

[22] Filed: Jul. 19, 1977

[51] Int. Cl.[2] ..... E21B 47/02

[52] U.S. Cl. ..... 175/44; 175/173; 175/58

[58] Field of Search ..... 175/40, 44, 45, 46, 175/173, 58, 236, 246; 33/804

[56] References Cited

U.S. PATENT DOCUMENTS

| | | | |
|---|---|---|---|
| 1,456,983 | 5/1923 | Hansen | 175/173 |
| 1,894,995 | 1/1933 | Macready | 175/44 |
| 2,657,013 | 10/1953 | Brady | 175/44 |
| 3,363,703 | 1/1968 | Shewmake | 175/44 |

FOREIGN PATENT DOCUMENTS

| | | | |
|---|---|---|---|
| 539755 | 4/1957 | Canada | 175/239 |

*Primary Examiner*—Ernest R. Purser
*Assistant Examiner*—Richard E. Favreau
*Attorney, Agent, or Firm*—Barlow & Barlow

[57] ABSTRACT

Method and apparatus for cutting a core in a bore hole and means of marking the core in which a groove is cut into the core along its length and providing an external arm in a definite angular relation to the core marking means and which may be aimed at some particular point so that when the core is removed, the marking on the core will be known to have the orientation with respect to the position that the arm is aimed such, for instance, as possibly a magnetic bearing or any other known reference mark on the surface to which the core may be related.

9 Claims, 9 Drawing Figures

METHOD AND APPARATUS FOR DETERMINING THE ORIENTATION OF A CORE CUT IN A BORE HOLE

BACKGROUND OF THE INVENTION

It is very desirous in obtaining sample cores from bore holes to know the direction that certain parts of the core bear with relation to the surface of the ground where the bore has been made, and in order to accomplish this, complicated mechanism has heretofore been used such, for instance, as a compass in the apparatus and photography. Disadvantages are had in this kind of mechanism because the drilling operation sets up vibrations in the coring equipment and drilling fluid that would blur the photograph causing it to be necessary to halt completely the drilling and fluid pumping operations and allow these vibrations to subside, which consumes time, in order that a clear photograph may be obtained. Further, with the use of a compass, the apparatus and the ground material must be non-magnetic so that the compass will not be affected, as for instance, in the device shown in U.S. Pat. No. 3,450,216 dated June 17, 1969. In addition, there exists in the art core taking apparatus where the core barrel is attached to the bottom end of the drill string, being isolated from the rotation by bearings, friction between the core and core barrel providing the only force holding the core barrel from rotating, all as shown in U.S. Pat. No. 3,004,614. If, however, the core should break, the core barrel will rotate, and all orientation will be lost. In fact, many prior core sampling apparatus rely on the integrity of the core.

SUMMARY OF THE INVENTION

In order to do away with the need for non-magnetic apparatus and the uncertainty of broken cores, a center or orienting rod is provided which has at its lower end a core receiving barrel attached in fixed angular relation to the orienting rod with one or more scribes extending radially inward of the barrel so that as the core passes therein, it will be longitudinally marked and related to apparatus at the upper and outer end of the orienting rod. This apparatus will be an arm or lever which is in a fixed angular relation to the rod and thus in a fixed angular relation to the marking scribes on the core receiving barrel. About the orienting rod there is a drill rod which encircles the orienting rod and has a coring bit at its lower end with an open center so that, as the core is formed by the bit, it will move in the core receiving barrel and be scribed by the scribes therein. Suitable rotational supports are provided between the outer drill rod and the orienting rod and means for passing drilling fluid down through the drill rod and between it and the orienting rod are provided for cooling and cleaning the coring bit. Conventional means are used for driving the drill rod, the simplicity of the arm on the orientation rod and its relation to the core providing orientation that may be easily comprehended by the operator.

DESCRIPTION OF THE PREFERRED EMBODIMENT

Figure 7:
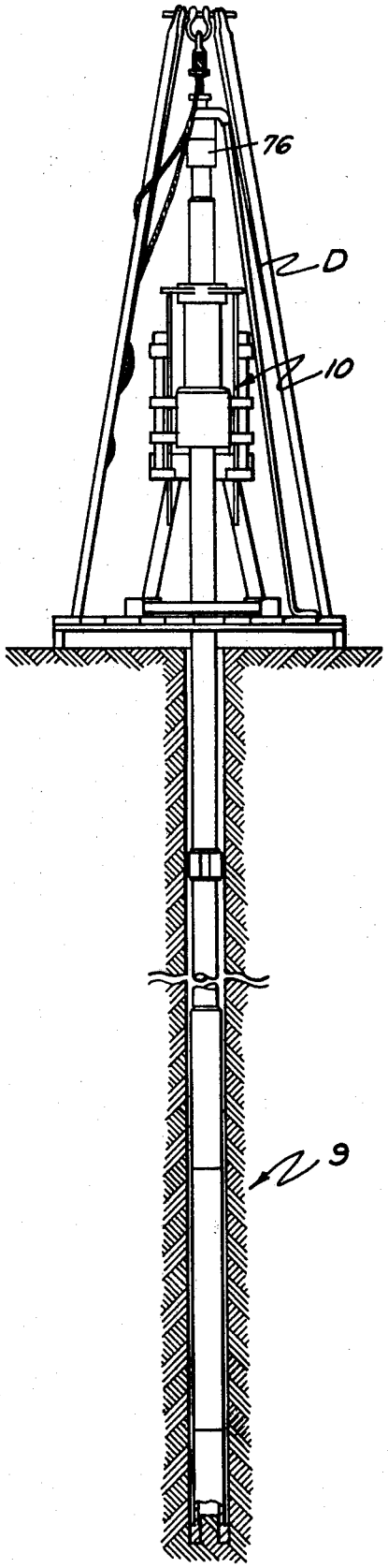
FIG. 7 is an elevation view partly in section showing the entire apparatus in working position.

Referring to FIG. 7, in drilling cores the device which is used is formed in several sections generally designated 9, suitably secured together, each having drill rod, an outer barrel and an inner core taking means. The drill rod may be rotated by a suitably powered rotary spindle 10, the entire operating rig being illustrated which is complete with derrick D, drillng fluid swivel 76, together with engine, water pump and drum hoist (not illustrated).

Figure 1:
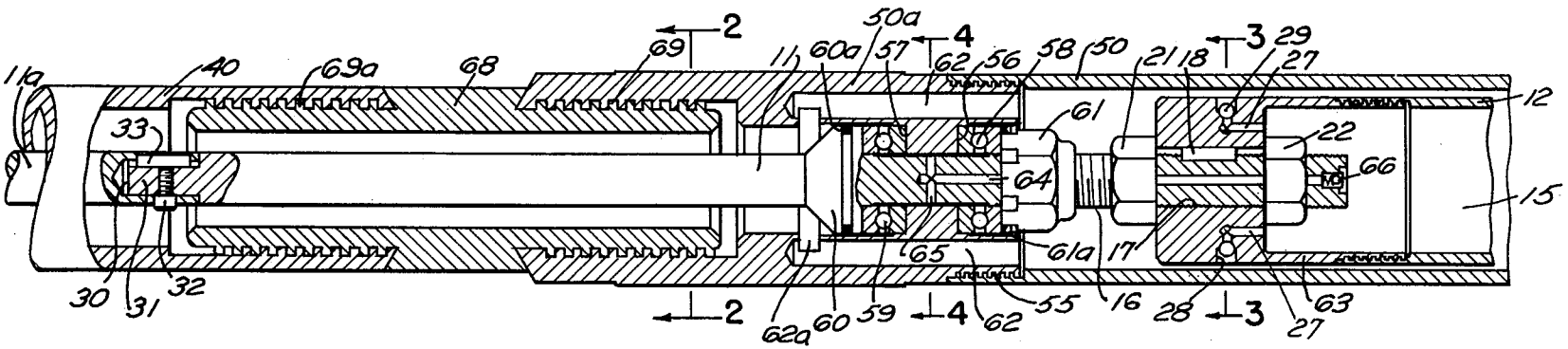
FIG. 1 is a portion in section of the device showing the outer drill rod and the inner orienting rod.
Figure 4:
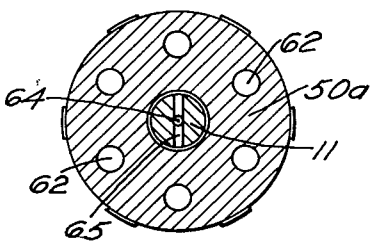
FIGS. 2, 3 and 4 are sections on lines 2—2, 3—3 and 4—4 of FIG. 1.
Figure 3:
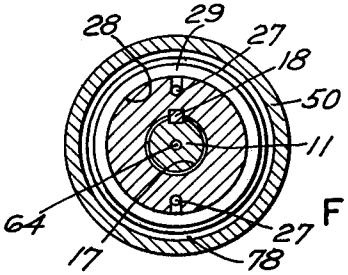
Figure 2:
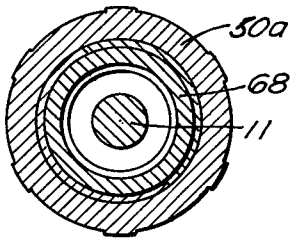
Figure 1A:
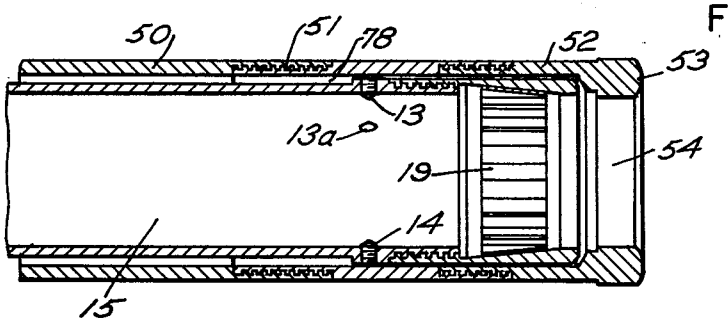
FIG. 1A shows the lower portion of the drill rod and core receiving barrel which is a continuation of the righthand end of FIG. 1.

Referring first to the inner core taking means, it comprises a plurality of sections 11*a*, 11*b*, 11*c* . . . . (FIG. 1) which are keyed together to form an orienting rod generally designated 11. At the lower end of the orienting rod, there is rotationally and axially secured a core receiving barrel 12 which carries scribing means 13, 13A and 14 so that, as the core is cut and moves into the center area 15 of the core receiving barrel, marks or grooves will be placed on the outer surface of the core which grooves extend generally axially of the core. The lower end of the core receiving barrel may include a core lifting device 19 that retains the core in the barrel when the entire assembly is removed from the bore hole. The core receiving barrel has a generally closed upper end and through this end there is axially drilled a keyed bore 17. The lower end of the orienting rod as will be seen in FIG. 1 is threaded, and this threaded portion 16 passes through the bore 17 with a key 18 securing the core receiving barrel against rotation, a pair of nuts 21 and 22 securing the barrel in adjustable position axially. The head of the core barrel is also provided with a plurality of small conduits 27 that extend upwardly and thence radially outward into a groove 28 which is closed by means of an O-ring 29. Thus, if any drilling fluid is trapped in the core barrel, it may pass by virtue of its pressure through these conduits 27 and 28, and out past the O-ring 29.

As has been mentioned, the orienting rod 11 is made up of a plurality of sections as necessary, so that above the basic or lower section 11, there may be added a number of additional orienting rod sections. For example, the rod section 11*a* is keyed to the section 11 by providing a socket 30 which receives a reduced end 31 of the rod 11, which end is held in position and keyed by means, respectively, of a holding screw 32 and a key 33. At the upper end of the orienting rod sections (see FIG. 5), there is an arm or pointing device 38, which in this case is receiving the reduced end 31*b* of the rod section 11*b*. Every joint of the rod 11 is keyed with key-like 33 and a holding screw 32. The pointing device 38 may have an indicator rod such as 39 extending therefrom for any length as required. As will be apparent from examining the drawings, each of the sections is held together in identical fashion, section 11*a* being held with the section 11b by a reduced end being received in a socket and held therein by a holding screw 32.

Surrounding the orienting rod, there is drill rod designated 40 which is illustrated as composed of several sections 40, 40a, et cetera, each section of which is threadingly coupled together throughout the length necessary. At the lower end of the drill rod section 40, there is threadingly secured thereto as at 69 an outer barrel head 50a and an outer barrel 50. At the lower end of the outer barrel, there is threadingly secured thereto as at 51 a core bit 52. The core bit has cutting elements 53, and the cut core can pass upwardly through an open center 54 into the hollow center 15 of the core receiving barrel which, as will become presently apparent, is supported non-rotatably within the outer barrel.

To this end, as will be seen in FIG. 1, there is provided an outer barrel head member 50a which is provided with threads at 55 that threadingly engage the outer barrel 50. This head member is provided with a central bore therethrough, and the central bore is counterbored as at 56 and 57 in which are, respectively, received bearing units 58 and 59. The orienting rod 11 is rotationally supported by these bearings 58 and 59, and as will be apparent from viewing the drawing is provided with means for stabilizing the axial position thereof by having an enlarged boss 60 with a seal 60a thereabout and a nut 61 that also has a seal 61a thereabout, the nut 61 being threadingly received on the threaded portions 16 of the extension rod portion 11. In addition, the outer barrel head member 50a has means therein for allowing drilling fluid to pass therethrough, and to this end is provided with a plurality of axially extending bores 62 that connect via a groove 62a to the open central portion of the drill rod assembly. Lubrication of the bearings is readily provided by means of an axially extending bore 64 and lateral passageway 65 which is fed through a grease fitting 66 in a fashion well known to those skilled in the art.

Continuing upwardly the outer barrel head 50a is coupled to the lowest section of drill rod 40 by means of a connector 68 which has threads 69 and 69a at either end thereof that engage corresponding threads in the drill rod sections 40 and outer barrel head 50a. The connector 68 is provided with a central bore therethrough which allows the passage of the orienting rod 11 as well as sufficient area for the passage of drilling fluid down through the drill rod as will be further explained presently. Each additional section of drill rod 40a, etc., to provide the proper length may be coupled onto drill rod section 40 and to each other by means of the same connector 68, or by a different connector, as required.

It will be noted that the orienting rod sections 11, 11a, 11b extend through the drill rod sections and couplings, and as has been explained above are supported for relative rotational movement with relation to the drill rod by means of bearings. However, in order to provide lateral support to the orienting rod as it extends upwardly through the various drill rod sections so that the same may be stabilized, spider-like stabilizers 72 are provided with retainers 73 holding the spiders onto the orienting rod sections as necessary as the same passes up through the drill rod string (see FIG. 5A).

Figure 5:
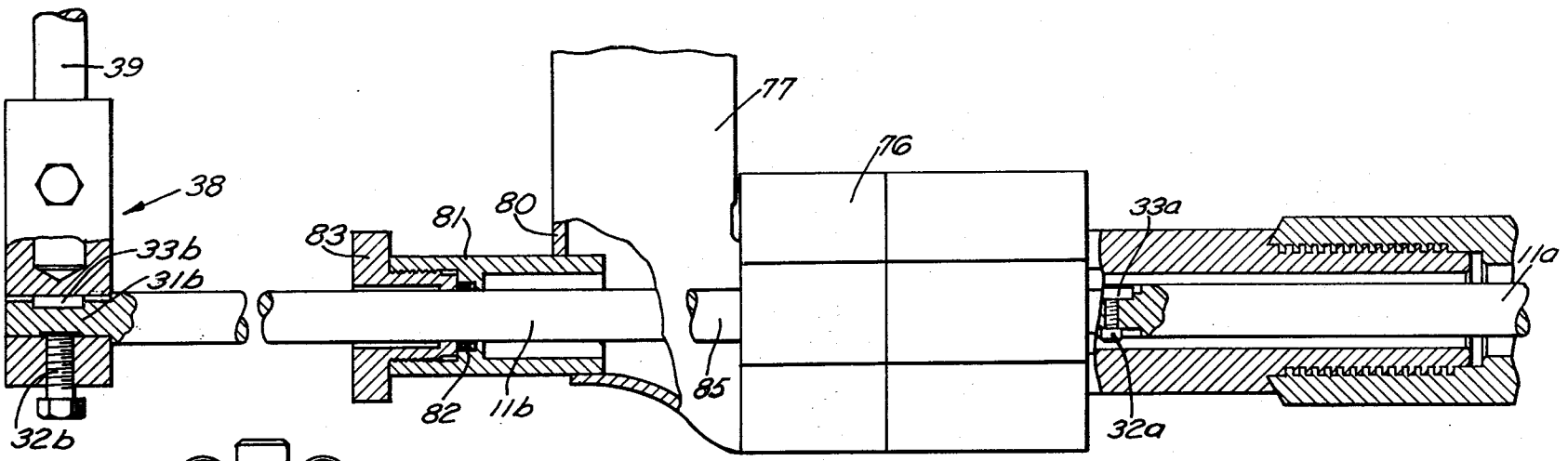
FIG. 5 is a portion partly in section of the upper end of the device, which would be a portion extending from the lefthand end of FIG. 1, and illustrates the drilling fluid swivel and the arm which extends from the orienting rod for alignment purposes.
Figure 5A:
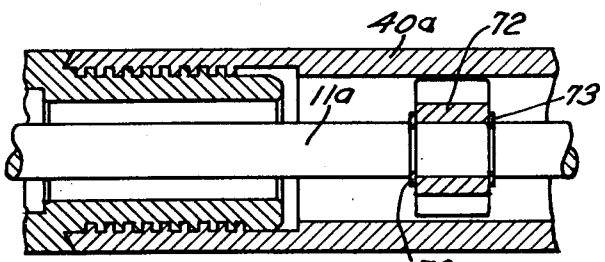
FIG. 5A is a section of a continuation of the righthand end of FIG. 5.
Figure 6:
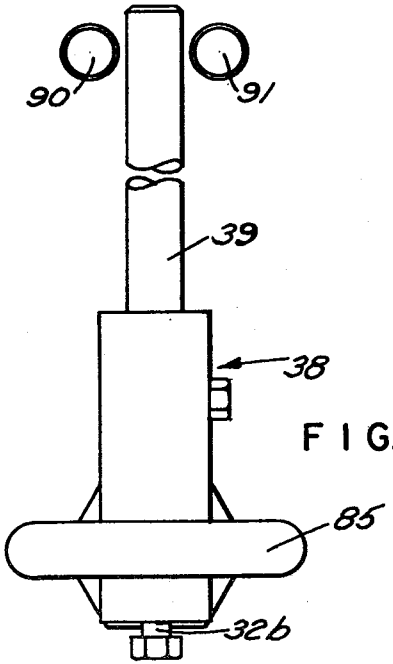
FIG. 6 is a top view of the structure shown in FIG. 5 and illustrating two guide rods which may engage the pointer or arm extending from the orienting rod.

Referring now to FIG. 5, the upper end of the drill rod string is provided with a drilling fluid swivel 76 which has a fluid inlet feed 77 thereto, through which fluid may be passed into the interior of the drill rod string through the open central portions of the drill rods and their respective couplings. It will be apparent to those skilled in the art that the drilling fluid passes downwardly therefore and thence through the passageway 62 in the section 50a and in between the outer wall of the core receiving barrel 12 and the inner wall of the outer barrel 50 and thence down through the open lower passageway 78 into the bottom of the hole which will carry the cuttings outwardly around the exterior of the outer barrel 50 and drill rod 40 to the top of the hole and will clean the core bit as well as cool the same. The orienting rod 11b passes through the swivel gooseneck as at 80 where a gland fitting 81 with a packing 82 and nut 83 is provided. The swivel may also be fitted with a bail 85 to lift the drill pipe string in the derrick D.

In use, driving means 10 at the upper end of the drill pipe drives the same circularly as it is passed down in the ground to cut a core which passes into the area 15. The core will be scribed by the scribes, one of which is oriented with a pointing device 40, 41 which may be oriented in such a fashion that it will point to some certain position either fixed on the ground or it may be to a certain compass bearing such as to north or the like. For example, a pair of vertical posts 90, 91 driven in the ground may maintain alignment. Thus, the core will be marked by reason of the alignment with one of the scribes such as 13 which may be differentiable from the other scribe 14 so that it may be known how the core lines up with a certain location above ground. The arm 39 may extend outwardly between aligning bars 90 and 91 so that it will maintain its position unless manually changed to orient the device in a different position. It, of course, will be understood that the device may be started at any point of orientation which is desirable. Further, if desired, the pointing device 40 and arm 41 may simply be left free and unrestrained with notations made of its compass bearing at various intervals during the coring operation. From the above, it will be apparent that the position of the scribes as received on the core is unaffected by interruptions in the coring operation or by breaks, seams, voids or any other faults that may exist in the material being cored.

I claim:

1. A device for orienting a core cut in a bore hole, an orienting rod, an inner core barrel fixed to the lower end of said rod, scribes projecting inwardly on the core barrel, a drill rod encircling said orienting rod, an outer barrel and coring bit at the lower end of said drill rod having a center opening communicating with said inner core barrel, said orienting rod extending upwardly beyond said drill rod and externally thereof, an arm extending radially from said orienting rod at the external upper end thereof in fixed relation to said rod and scribes on said barrel, means providing drilling fluid passageway between said drill rod and the parts encircled thereby and means for driving said drill rod, said orienting rod at the location of said arm extending above said core barrel and outer barrel leaving the arm visible to indicate the position of the scribes.

2. A device as in claim 1 wherein means are provided for the vertical positioning of said inner core barrel within said outer barrel is adjustable.

3. A device as in claim 1 wherein an anti-friction bearing between said orienting rod and said drill rod is located between upper end and lower end of said device.

4. A device as in claim 1 wherein said orienting rod is in sections keyed to each other.

5. A device as in claim 1 wherein said drill rod is in sections drivingly connected to each other.

6. A device as in claim 1 wherein a drilling fluid swivel embraces said drill rod and said orienting rod extends through the drilling fluid swivel and is surrounded by a packing gland.

7. The method of directional orientation of a core cut in a bore hole which comprises providing a core barrel with fixed scribes thereon to receive a core cut by a coring bit and projected thereinto to obtain a scribe thereon, attaching to said core barrel a rod in fixed rotational relation to said scribes and extending externally out through the upper end of a device used for scribing the core and fixing to the outer end of said rod an arm in radial relation to said rod and scribes, said arm indicating outside of the bore hole the position of the scribes as received on the core.

8. A device as in claim 7 wherein said orienting rod is used to prevent rotational movement of said inner core barrel.

9. A method as in claim 7 including directing said indicating arm in a desired orientation to locate the position of the scribes as received on the core.

* * * * *